United States Patent [19]

Zoleski et al.

[11] 4,358,386

[45] Nov. 9, 1982

[54] MARINE CRANKCASE LUBRICANT

[75] Inventors: Benjamin H. Zoleski, Beacon; Rodney L. Sung, Fishkill; Stephen A. Levine, Fishkill; William P. Cullen, Fishkill, all of N.Y.

[73] Assignee: Texaco Inc., White Plains, N.Y.

[21] Appl. No.: 291,584

[22] Filed: Aug. 10, 1981

[51] Int. Cl.[3] ..... C10M 1/48

[52] U.S. Cl. ..... 252/32.7 E; 252/42.7; 252/50; 252/51.5 A

[58] Field of Search ..... 252/32.7 E, 42.7, 50, 252/51.5 A

[56] References Cited

U.S. PATENT DOCUMENTS

| | | | |
|---|---|---|---|
| 2,320,392 | 6/1943 | White | 252/51.5 A X |
| 2,468,012 | 4/1949 | Isbell | 562/553 |
| 2,810,752 | 10/1957 | Freese | 562/553 |
| 3,003,961 | 10/1961 | Andress, Jr. et al. | 252/51.5 A X |
| 3,116,252 | 12/1963 | Beretuas | 252/51.5 A |
| 3,123,570 | 3/1964 | Bonner et al. | 252/32.7 E |
| 3,390,081 | 6/1968 | Floeck | 252/32.7 E |
| 3,856,687 | 12/1974 | Lowe | 252/33.4 |
| 4,086,172 | 4/1978 | Lowe | 252/32.7 E X |
| 4,210,541 | 7/1980 | Mann | 252/32.7 E |
| 4,283,294 | 8/1981 | Clarke | 252/42.7 X |

*Primary Examiner*—Andrew Metz

*Attorney, Agent, or Firm*—Carl G. Ries; Robert A. Kulason; James J. O'Loughlin

[57] ABSTRACT

A marine crankcase lubricating oil composition characterized by having a Total Base Number from about 3 to 10 comprising a mineral lubricating oil, an overbased calcium alkylphenolate, a zinc dihydrocarbyl dithiophosphate, an ethoxylated alkylphenol, and an N-alkylglycine derivative having the formula:

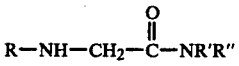

(a)

in which R is a hydrocarbyl radical having from about 10 to 25 carbon atoms, R′ represents hydrogen or an alkyl, hydroxyalkyl or an aminoalkyl radical having from 1 to 5 carbon atoms and R″ represents an alkyl or hydroxyalkyl radical having from 1 to 5 carbon atoms or a $—CH_2—CH_2—NH)_xH$ radical in which x has a value from 1 to 3, or

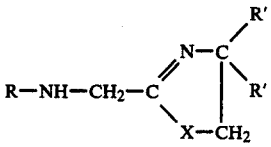

(b)

in which X represents an oxygen atom or a divalent N-R′ radical and R and R′ have the values noted above.

10 Claims, No Drawings

MARINE CRANKCASE LUBRICANT

BACKGROUND OF THE INVENTION

1. Field of the Invention

Energy costs, particularly as illustrated by the cost of crude oil and liquid petroleum distillates derived from crude oil have escalated rapidly. These costs are especially burdensome to the users of transportion fuels, such as shipowners, and these major consumers of petroleum products are reacting to these events by searching for more efficient measures to use in their operations. One significant development in the shipping field is the trend away from steam turbine propulsion units in favor of large marine diesel engines which are more fuel efficient with respect to petroleum fuels.

The largest marine diesel engines used for ship propulsion are classified as slow speed marine diesel engines. These engines are unique both in their size and in their method of operation. The engines themselves are massive, the larger units approaching 2000 tons in weight and upwards of 100 feet long and 45 feet in height. Their output can reach 50,000 brake horsepower with engine revolutions ranging from about 100 to 125 revolutions per minute.

The slow speed marine diesel engines are unique in their design. Most notably, the crankcase of the large slow speed single acting 2-stroke crosshead type of engine is completely separate from the combustion zone of the engine, i.e. there is no direct communication between the combustion zone and the crankcase zone of this engine. This has led to the use of two different lubrication systems to lubricate a slow speed marine diesel engine. The cylinders in the combustion zone are lubricated with a highly basic 50 to 100 TBN lubricant which functions to counteract the high acidity generated because of the use of a high sulfur residual fuel.

The problems encountered in the crankcase of a slow speed marine diesel engine relate to engine wear, lubricant oxidation problems and water separation characteristics which are essential in a shipboard environment. The essential requirements for a crankcase lubricant for this engine include an anti-wear additive, an oxidation-corrosion inhibitor and a demulsifying agent to maintain the operability and effectiveness of the lubricant.

The fuel consumption rate of a marine diesel engine of 30,000 horsepower ranges upwards of 1200 gallons of fuel per hour. In view of the current need to reduce overall oil consumption, intensive efforts are being made to discover lubricating oil compositions which can materially reduce the friction losses which take place within the engine itself. Reductions in engine friction losses translate directly into significant fuel savings.

Numerous means have been employed to reduce the friction in internal combustion engines. These range from the use of lower viscosity lubricating oils or mixtures of mineral and synthetic lubricating oils as well as to the incorporation of friction-reducing additives such as graphite, molybdenum compounds and other chemical additives. There are limits to the extent to which the viscosity of a lubricating oil can be reduced for the purpose of reducing friction. Generally, a lubricating oil having too light a viscosity will fail to prevent metal-to-metal contact during high load operating conditions with the result that unacceptable wear will occur in the engine. With respect to chemical anti-friction additives, significant research efforts are ongoing to find effective and economic anti-friction additives which exhibit stability over an extended service life and under a wide range of operating conditions.

It is an object of this invention to provide a novel crankcase lubricating oil composition for a large slow speed marine diesel engine.

It is another object of this invention to provide a slightly overbased crankcase lubricating oil having improved friction properties for lubricating a slow speed marine diesel engine.

A further object is to provide a lubricating oil composition having good demulsifying and water separation properties.

2. Description of the Prior Art

U.S. Pat. Nos. 2,468,012 and 2,810,752 disclose methods for making amide derivatives of N-alkylglycine and their use as laundry detergents.

A copending application, Ser. No. 291,582, filed on Aug. 10, 1981, discloses a cylinder lubricating oil composition for a slow speed marine diesel engine.

SUMMARY OF THE INVENTION

The crankcase lubricating oil composition of this invention comprises a lubricating oil, an overbased calcium alkylphenolate in an amount sufficient to impart a Total Base Number ranging from about 3 to 10 to the lubricating oil composition, a zinc dihydrocarbyl dithiophosphate, an ethoxylated alkylphenol, and a minor amount of an N-alkylglycine derivative represented by the formula:

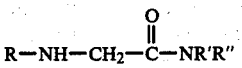

(I)

where R is a hydrocarbyl radical having from about 10 to 25 carbon atoms, R′ represents hydrogen or an alkyl, hydroxyalkyl or an aminoalkyl radical having from 1 to 5 carbon atoms and R″ represents an alkyl or a hydroxyalkyl radical having from 1 to 5 carbon atoms or a $-(CH_2-CH_2-NH)_xH$ radical in which x has a value from 1 to 3, or a derivative represented by the formula:

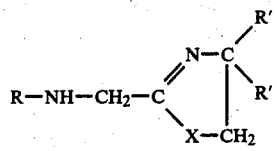

(II)

in which X represents an oxygen atom or a divalent N—R′ radical and R and R′ have values noted above.

The novel method of the invention involves operating a slow speed marine diesel engine by supplying the above-described lubricating oil composition to the crankcase lubrication system of said engine.

SPECIFIC EMBODIMENTS OF THE INVENTION

In a more specific embodiment of the invention, the crankcase lubricating composition of the invention will comprise at least 80 weight percent of a mineral lubricating oil, from about 1 to 5 weight percent of an overbased calcium alkylphenolate or a sulfurized overbased calcium alkylphenolate sufficient to impart a Total Base Number to the lubricating oil composition ranging between about 3 and 8, from about 0.1 to 1 weight percent of a zinc dithiophosphate represented by the formula:

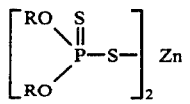

in which R is a hydrocarbyl radical or a hydroxy substituted hydrocarbyl having from about 3 to 12 carbon atoms, from about 0.05 to 1 weight percent of an ethoxylated alkylphenol having the formula:

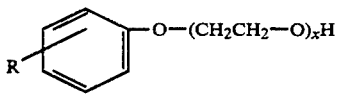

in which R is a hydrocarbyl radical having from about 4 to 16 carbon atoms and x has a value from 1 to 10, and a minor friction modifying amount of an N-alkylglycine derivative selected from the group having the formula:

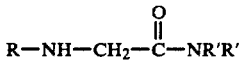

in which R is a hydrocarbyl radical having from about 10 to 25 carbon atoms, R′ represents hydrogen or an alkyl, hydroxyalkyl or an aminoalkyl radical having from 1 to 5 carbon atoms and R″ represents an alkyl or a hydroxyalkyl radical having from 1 to 5 carbon atoms or a $-(CH_2-CH_2-NH)_xH$ radical in which x has a value from 1 to 3, and a derivative represented by the formula:

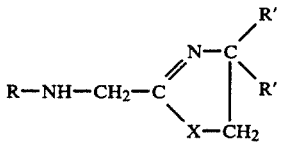

in which X represents an oxygen atom or a divalent N—R′ radical and R and R′ have the values noted above.

A preferred N-alkylglycine-amide friction modifying component of the lubricating oil composition of the invention is represented by the following formula:

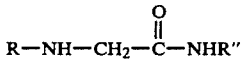

in which R is an alkyl radical having from about 12 to 20 carbon atoms and R″ is a $-(CH_2-CH_2-NH)_xH$ radical in which x has a value from 1 to 2. A still more preferred compound of this type is one in which R has from 16 to 18 carbon atoms.

The essential N-alkylglycine amide friction modifier of the invention is generally prepared in two steps involving first the reaction of an aliphatic primary amine with a halogenated acetic acid, such as chloroacetic acid, to form the intermediate N-alkylglycine followed by a reaction of the intermediate N-alkylglycine with an amine to form the prescribed N-alkylglycine-amide.

The aliphatic primary amines which can be employed in the first step of this process are represented by the formula $RNH_2$ in which R is a monovalent saturated or unsaturated aliphatic hydrocarbon or hydrocarbyl radical having from about 10 to 25 carbon atoms. The preferred aliphatic primary amines have from 12 to 20 carbon atoms with the most preferred having from 16 to 18 carbon atoms. The aliphatic primary amines found to be effective are those having essentially straight chain alkyl radicals. Aliphatic monoamines having a minor amount of chain branching, i.e. less than about 5 percent branched alkyl radicals attached to the main straight chain or backbone hydrocarbyl radical can be employed.

Examples of specific aliphatic primary amines suitable for this reaction include n-decylamine, n-dodecylamine, n-tetradecylamine, n-hexadecylamine, n-octadecylamine and aliphatic primary amines derived from natural products, such as coco-amine which averages about 12 aliphatic carbon atoms, and tallow-amine, oleyl-amine and soya-amine which average about 18 aliphatic carbon atoms.

The aliphatic primary amine is reacted with a halogenated acid represented by the formula:

$$XCH_2-COOH$$

in which X represents a halogen atom, such as chlorine, bromine and iodine to produce an intermediate N-alkylglycine as illustrated below:

$$R-NH_2+XCH_2-COOH \rightarrow R-NH-CH_2-COOH+HX$$

In general, the aliphatic primary amine is dissolved in an inert solvent, such as a hydrocarbon solvent, together with an acid acceptor. The haloacetic acid is gradually added to the mixture and the entire mixture is then heated to its reflux temperature and maintained at this temperature for a sufficient length of time for the reaction to be completed. This intermediate reaction mixture is then filtered and cooled.

In the second step, the mixture containing the intermediate N-alkylglycine is reacted with an amine compound which can react with the carboxylic acid group on the N-alkylglycine to form an amide. The amine compound which can be employed in this step of the process is represented by the formula:

$$HNR'R''$$

in which R′ represents hydrogen or an alkyl, hydroxyalkyl or aminoalkyl radical having from 1 to 5 carbon atoms and R″ represents an alkyl or a hydroxyalkyl radical having from 1 to 5 carbon atoms or a $-(CH_2-CH_2-NH)_xH$ radical in which x has a value from 1 to 3. Examples of amines suitable for this step in the process include ethylenediamine, diethylenetriamine, triethylenetetramine, diethanolamine, N-ethylethylenediamine, and 1,3-propanediamine.

In the final step of the process, the prescribed amine compound is added to the solvent mixture containing the intermediate N-alkylglycine and this new mixture is heated to its reflux temperature and maintained at this temperature until all the water split out in the reaction has been removed. The final reaction product is filtered and stripped of solvent under a vacuum.

The following examples illustrate the preparation of specific friction reducing additive component for the diesel crankcase oil composition of the invention.

EXAMPLE I

Preparation of N,N-bis(2-hydroxyethyl)-N'-tallow glycine amide 276 parts of a commercial tallow amine (Armeen T-tallow amine) and 53 parts of sodium carbonate were dissolved in a solvent mixture of 400 parts hexane and 400 parts xylene. 94 parts of chloroacetic acid were slowly added to this mixture. The mixture was then heated to reflux temperature and maintained at this temperature until all the water formed in the reaction was removed as an azeotrope. The intermediate reaction product containing N-n-octadecylglycine was then cooled.

104 parts of diethanolamine was added to the foregoing intermediate reaction product and the new mixture heated to reflux temperature and maintained at this temperature until all of the water of the reaction had been removed as an azeotrope. The final reaction product was filtered and stripped of solvent under a vacuum. The product was analyzed by elemental analysis and IR indicating the preparation of the prescribed product corresponding to the formula:

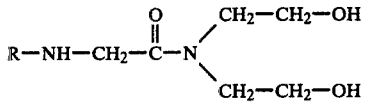

wherein R represents an n-hydrocarbyl radical derived from tallow.

EXAMPLE II

Preparation of N-tallow glycyl amide of ethylenediamine 275 parts of tallow primary amine (Armeen T), and 53 parts of sodium carbonate were added to a mixture consisting of 400 parts of xylene and 400 parts of hexane. 95 parts of chloroacetic acid were slowly added to this mixture. The mixture was heated to reflux temperature and maintained at this temperature until all the water produced in the reaction had been removed completing the formation of the N-n-octadecylglycine.

60 parts of ethylenediamine were added to the cooled intermediate reaction product prepared above. This mixture was heated to its reflux temperature and maintained at this temperature until all the water of reaction had been removed as an azeotrope. The final product was filtered and stripped of solvent under a vacuum. The product was analyzed by elemental analysis and IR indicating the preparation of N-tallow glycyl amide of ethylenediamine corresponding to the formula:

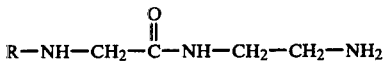

wherein R represents an n-hydrocarbyl radical derived from tallow.

EXAMPLE III

Preparation of N-oleyl glycyl amide of ethylenediamine 270 parts of oleyl amine (Armeen O), and 53 parts of sodium carbonate were added to a mixture consisting of 400 parts of xylene and 400 parts of hexane. 945 parts of chloroacetic acid were slowly added to this mixture. The mixture was then refluxed and maintained at this temperature until all the water produced in the reaction had been removed.

60 parts of ethylenediamine were added to the cooled intermediate reaction product prepared above. This mixture was heated to its reflux temperature and maintained at this temperature until all the water of reaction had been removed as an azeotrope. The final product was filtered and stripped of solvent under a vacuum. The product was analyzed by elemental analysis and IR indicating the preparation of N-oleyl glycyl amide of ethylenediamine corresponding to the formula:

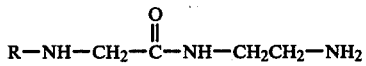

wherein R represents an n-hydrocarbylene radical derived from oleic acid.

EXAMPLE IV

Preparation of N-coco glycyl amide of ethylenediamine 204 parts of coco-amine (Armeen C derived from coconut oil) and 53 parts of sodium carbonate were added to a mixture consisting of 400 parts of xylene and 400 parts of hexane. 94.5 parts of chloroacetic acid were slowly added to this mixture. The mixture was then refluxed and maintained at this temperature until all the water produced in the reaction had been removed.

60 parts of ethylenediamine were added to the cooled intermediate reaction product prepared above. This mixture was heated to its reflux temperature and maintained at this temperature until the water of reaction had been removed. The filtered and stripped final product was analyzed by elemental analysis and IR indicating the preparation of N-coco glycyl amide of ethylenediamine corresponding to the formula:

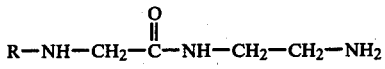

wherein R is predominantly an n-hydrocarbyl radical derived from coco.

EXAMPLE V

Preparation of 1-(2-ethylamine)-2-N-tallow-aminomethyl)imidazoline 275 parts of a primary amine obtained by aminating tallow (Armeen T) and 79 parts of pyridine were added to a mixture consisting of 400 parts xylene and 400 parts hexane. 25 parts of chloroacetic acid were added to the mixture. This mixture was refluxed for 3 hours and filtered and cooled.

77 parts of diethylenetriamine was added to one-half of the foregoing product mixture and this reaction mixture was heated to reflux and maintained at this temperature until the whole other water separated in the reaction had been azeotroped from the reaction mixture. The final reaction product was filtered and stripped under a vacuum and analyzed by elemental analyses and IR and found to contain 1-(2-ethylamine)-2-(N-tallow-aminomethyl)imidazoline corresponding to the formula:

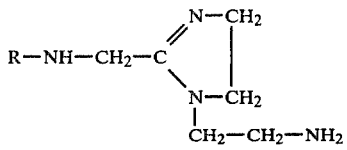

in which R is a hydrocarbyl radical derived from tallow.

EXAMPLE VI

Preparation of 2-(N-tallow-aminomethyl)-4-ethyl-4-methylol-oxazoline 47.5 parts of chloroacetic acid were slowly added to a mixture of 137.5 parts of tallow amine (Armeen T) and 39.5 parts of pyridine in 200 parts hexane and 200 parts xylene. On completion of a chloroacetic acid condition, the reaction mixture was refluxed for 3 hours and then cooled. 59.5 parts of 2-amino-2-ethyl-1,3-propanediol were added to the foregoing intermediate reaction product and the new reaction mixture was heated to reflux and maintained at this temperature until all the water separated in the reaction had been removed. The final reaction product was filtered and stripped and analyzed by elemental analysis and IR to indicate the presence of 2-(N-tallow-aminomethyl)-4-ethyl-4-methylol-oxazoline having the formula:

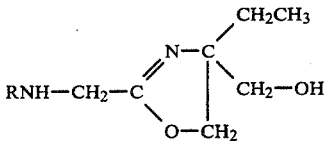

in which R is a hydrocarbyl radical derived from tallow.

The friction modifying component of the diesel cylinder lubricating oil composition of the invention is effective in a range from about 0.2 to 5 weight percent based on the total lubricating oil composition. However, it is preferred to employ from about 0.5 to 2 weight percent of the N-alkylglycine derivative on the lubricating oil with the most preferred concentration ranging from about 0.75 to 1.5 weight percent.

A second essential component of the crankcase lubricating oil composition of the invention is an overbased calcium alkylphenolate or phenate or a sulfurized overbased calcium alkylphenolate in a sufficient amount to provide a Total Base Number ranging from about 3 to 10 in the finished crankcase lubricating oil composition. Total Base Number (TBN) is a measure of alkalinity determined according to the test procedure outlined in ASTM D-664.

The alkalinity agent comprises at least one overbased calcium alkylphenolate or sulfurized overbased calcium alkylphenolate including the corresponding calcium carbonate overbased calcium alkylphenolate salt. In general, these materials are prepared by reacting a alkylphenol in which the alkyl radical has from 5 to 50 carbon atoms, preferably from 10 to 20 carbon atoms with a basic calcium compound such as calcium oxide, calcium hydroxide, calcium alkoxyalkoxide, or calcium carbonate to effect the formation of the overbased calcium alkylphenolate. If the corresponding sulfurized compound is desired, sulfur is reacted with the calcium alkylphenolate prior to or after it has been converted to its overbased form. Methods for making overbased calcium alkylphenolates are well known and do not constitute a part of this invention. Specific details for preparing overbased calcium alkylphenolates and sulfurized overbased calcium alkylphenolates are disclosed in U.S. Pat. Nos. 3,779,920 and 3,761,414 and the disclosures in these references are incorporated herein by reference.

The prescribed alkylphenolate is employed in the crankcase lubricant of the invention in a concentration sufficient to provide a Total Base Number from about 3 to 8, and preferably from 5 to 6, in the finished lubricating oil composition. In general, this will require from about 1 to 5 weight percent of the alkylphenolate salt on a neat basis.

The essential zinc dithiophosphate component of the lubricating oil is represented by the formula:

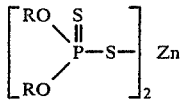

in which R is a hydrocarbyl radical or a hydroxy-substituted hydrocarbyl radical having from 3 to 12 carbon atoms. The preferred zinc dithiophosphates are those in which R represent an alkyl radical having from 4 to 8 carbon atoms. Examples of suitable compounds include zinc isobutyl 2-ethylhexyl dithiophosphate, zinc di(2-ethylhexyl) dithiophosphate, zinc isoamyl 2-ethylhexyl dithiophosphate, zinc di(phenoxyethyl)dithiophosphate and zinc di(2,4-diethylphenoxyethyl)dithiophosphate. In general, these compounds are employed in the oil composition in a concentration ranging from about 0.1 to 1.0 weight percent with a preferred concentration ranging from about 0.5 to 1.5 percent. These compounds can be prepared from the reaction of a suitable alcohol or mixture of alcohols with phosphorus pentasulfide. They are illustrated in U.S. Pat. Nos. 2,344,395, 3,293,181 and 3,732,167 which are incorporated herein by reference.

The ethoxylated alkylphenol is an essential demulsification and water separation component for a marine diesel crankcase lubricating oil composition. This component is represented by the formula:

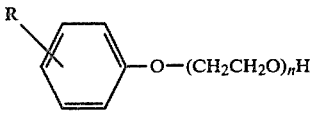

wherein R represents an alkyl radical having from 4 to 20 carbon atoms and n has an average value ranging from about 4 to about 30. A preferred ethoxylated alkylphenol is one in which R is an alkyl radical having from about 8 to 12 carbon atoms and n has a value ranging from 5 to 10. Ethoxylated alkylphenols are disclosed in U.S. Pat. No. 3,548,949 and this disclosure is incorporated herein by reference.

The ethoxylated alkylphenol is employed in the lubricating oil composition of the invention in a concentration ranging from about 0.05 to 1 weight percent. However, it is preferred to employ from about 0.1 to 0.5 weight percent of this additive the most preferred concentration being from about 0.2 to 0.4 weight percent.

The prescribed lubricating oil composition of the invention may contain additional known lubricating oil additives. An oxidation inhibitor which can be beneficially employed is an alkylated diphenylamine represented by the formula:

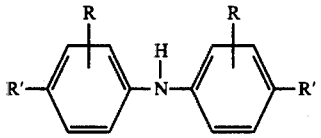

in which R is an alkyl radical having from 1 to 4 carbon atoms and R′ is an alkyl radical having from about 4 to 16 carbon atoms. A more preferred compound is one in which R′ is a tertiary alkyl hydrocarbon radical having from 6 to 12 carbon atoms. Examples of typical compounds include 2,2′-diethyl, 4,4′-tert. dioctyldiphenylamine, 2,2-diethyl, 4,4′-tert. dioctylphenylamine 2,2′-diethyl, 4-tert. octyldiphenylamine, 2,2′-dimethyl-4,4′-tert. dioctyldiphenylamine, 2,5-diethyl,4,4′-tert.-dihexyldiphenylamine, 2,2,2′,2′-tetraethyl, 4,4′-tert. didodecyldiphenylamine and 2,2′ dipropyl4,4′-tert. dibutyldiphenylamine. Mixtures of the foregoing compounds can be employed with equal effectiveness. The alkylated diphenylamine is normally employed in an oil composition in a concentration ranging from about 0.1 to 2.5 percent weight percent based on the weight of the lubricating oil composition, with the preferred concentration being from about 0.25 to 1.0 percent.

The hydrocarbon oil which can be employed to prepare the diesel lubricating oil composition of the invention includes naphthenic base, paraffinic base and mixed base mineral oils, lubricating oil derived from coal products and synthetic oils, e.g., alkylene polymers such as polypropylene and polyisobutylene of a molecular weight of between about 250 and 2500. Advantageously, a lubricating base oil having a lubricating oil viscosity SUS at 100° F. of between about 50 and 1500, preferably between 100 and 1200, are normally employed for the lubricant composition. The most preferred lubricating viscosity for a crankcase lubricating oil composition is a viscosity ranging from about 56 to 68 SUS at 210° F. The hydrocarbon oil will generally constitute from about 80 to 90 weight percent of the total lubricating oil composition with the preferred concentration range being from about 82 to about 88 weight percent.

The improvement in fuel economy brought about by the novel crankcase lubricant composition of the invention was demonstrated in the Small Engine Friction Test. The Small Engine Friction Test (SEFT) uses a single cylinder, air-cooled, 6-horsepower engine driven by an electric motor. The engine has a cast-iron block and is fitted with an aluminum piston and chrome-plated rings. The electric motor is cradle-mounted so that the reaction torque can be measured by a strain arm. The engine is housed in a thermally insulated enclosure with an electric heater and is driven at 2000 rpm.

Prior to each test, the engine is flushed three times with 1-quart charges of test oil. During the test run, the engine and oil temperatures are increased continually from ambient until a 280° F. oil temperature is reached. The heat comes from engine friction, air compression work and from the electric heater. The engine and oil temperatures and the engine motoring torque are recorded continually during the test. A SEFT run takes about 4 hours. Each test oil evaluation is preceded by a run on a reference oil for a like period of time. The torque reference level for the engine shifts very slowly with time as a result of engine wear. Therefore, the test oil results were recorded compared to a reference band consisting of data from up to three reference runs made before and three runs made after the test oil evaluation.

The frictional effects of the novel lubricating oil composition of the invention containing the prescribed N-alkylglycine friction modifier was evaluated in a commercial marine diesel lubricating oil composition. The commercial lubricant or base oil and the modified oil containing the friction modifier of the invention were tested for their friction properties in the Small Engine Friction Test described above.

The following examples illustrate the effectiveness of the additive of the invention in a 6 TBN marine crankcase oil composition.

TABLE I

SMALL ENGINE FRICTION TEST ON 6 TBN MARINE CRANKCASE OIL

| Composition, Wt. % | Marine Crankcase Oil (Base Oil) | Modified Marine Crankcase Oil A | Modified Marine Crankcase Oil B |
|---|---|---|---|
| Solvent Neutral Oil - SUS at 100° F. of 230 | 23.82 | 23.82 | 23.82 |
| Solvent Neutral Oil - SUS at 100° F. of 1575 | 71.48 | 70.48 | 70.48 |
| Zinc Dithiophosphate(1) | 0.50 | 0.50 | 0.50 |
| Overbased sulfurized calcium phenate(2) | 3.60 | 3.60 | 3.60 |
| Ethoxylated phenol(3) | 0.30 | 0.30 | 0.30 |
| Alkylated diphenylamine(4) | 0.30 | 0.30 | 0.30 |
| Dimethyl silicone, ppm | 150 | 150 | 150 |
| Additive Example II | — | 1.00 | — |
| Additive Example III | | | 1.00 |

(1)Zinc salt of mixed ($C_4$–$C_2$) alcohols/$P_2S_5$ product; 11.5% Zn
(2)Overbased sulfurized calcium alkylphenate of 147 TBN (Oronite 218A)
(3)Nonylphenol ethoxylated with 6 ethylene oxide moieties
(4)A mixture of mono- and dimethyldiphenylamine

TABLE II

SMALL ENGINE FRICTION TEST

| | Marine Crankcase Oil (Base Oil) | Modified Crankcase Oil (Oil A) | Modified Crankcase Oil (Oil B) |
|---|---|---|---|
| Engine Motor Torque, Foot Lbs. at 280° F. | 2.98 | 2.51 | 2.45 |
| Frictional Improvement over Base Oil, % | — | 15.8 | 17.7 |

The foregoing examples demonstrate an unexpected effectiveness of N-alkyl glycyl amides of alkylene polyamines as friction modifiers for reducing engine motor torque in the prescribed marine crankcase oil composition of the invention to provide attendant fuel economies.

We claim:

1. A crankcase lubricating oil composition having a Total Base Number ranging from about 3 to 10 comprising a major proportion of a mineral lubricating oil containing from about 1 to 5 weight percent of at least one overbased salt selected from the group consisting of calcium alkylphenolate, sulfurized calcium alkylphenolate and mixtures thereof, from about 0.1 to 1 weight percent of a zinc dithiophosphate represented by the formula:

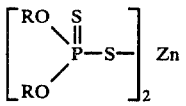

in which R is a hydrocarbyl radical or a hydroxy substituted hydrocarbyl radical having from 3 to 12 carbon atoms, from about 0.05 to 1 weight percent of an ethoxylated alkylphenol represented by the formula:

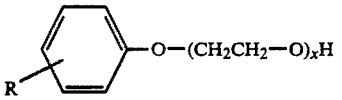

wherein R represents an alkyl radical having from 4 to 20 carbon atoms and n has an average value ranging from about 4 to about 30 and, from about 0.2 to 5 weight percent of a N-alkylglycine derivative selected from the group consisting of:

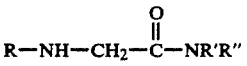

(a)

in which R is a hydrocarbyl radical having from about 10 to 25 carbon atoms, R′ represents hydrogen or an alkyl, hydroxyalkyl or an aminoalkyl radical having from 1 to 5 carbon atoms and R″ represents an alkyl or hydroxyalkyl radical having from 1 to 5 carbon atoms or a $-(CH_2-CH_2-NH)_xH$ radical in which x has a value from 1 to 3, and

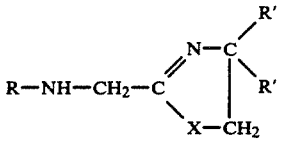

(b)

in which X represents an oxygen atom or a divalent N—R′ radical and R and R′ have the values noted above.

2. A crankcase lubricating oil composition according to claim 1 in which said N-alkylglycine derivative is represented by the formula:

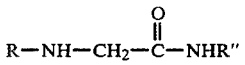

in which R is a hydrocarbyl radical having from 12 to 20 carbon atoms and R″ is a $-(CH_2-CH_2-NH)_xH$ radical in which x has a value from 1 to 2.

3. A crankcase lubricating oil composition according to claim 1 in which R is said N-alkylglycine derivative is a hydrocarbyl radical having from 16 to 18 carbon atoms.

4. A crankcase lubricating oil composition according to claim 1 containing from about 12 to 18 percent of an overbased calcium sulfonate having a Total Base Number ranging from 350 to 425.

5. A crankcase lubricating oil composition according to claim 1 containing from about 0.2 to 5 weight percent based on said lubricating oil composition of said N-alkylglycine derivative.

6. A crankcase lubricating oil composition according to claim 1 in which said N-alkylglycine derivative is N-tallow glycyl amide of ethylenediamine represented by the formula:

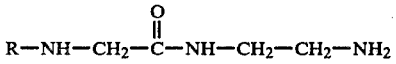

wherein R represents a hydrocarbyl radical derived from tallow.

7. A crankcase lubricating oil composition according to claim 1 in which said N-alkylglycine derivative is N-coco glycyl amide of ethylenediamine represented by the formula:

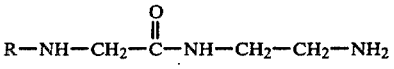

wherein R represents a hydrocarbyl radical derived from coconut oil.

8. A crankcase lubricating oil composition according to claim 1 in which said N-alkylglycine derivative is N,N-bis(2-hydroxyethyl)-N′-tallow glycine amide.

9. A crankcase lubricating oil composition according to claim 1 in which the concentration of said N-alkylglycine derivative ranges from about 0.75 to 1.5 weight percent.

10. A crankcase lubricating oil composition according to claim 1 in which the alkyl radical in said N-alkylglycine derivative has from 16 to 18 carbon atoms.

* * * * *